US005470698A

United States Patent [19]

Wen

[11] Patent Number: 5,470,698

[45] Date of Patent: Nov. 28, 1995

[54] ULTRATHIN TABULAR GRAIN EMULSION

[75] Inventor: Xin Wen, Rochester, N.Y.

[73] Assignee: Eastman Kodak Company, Rochester, N.Y.

[21] Appl. No.: 268,362

[22] Filed: Jun. 30, 1994

[51] Int. Cl.[6] ..... G03C 1/035

[52] U.S. Cl. ..... 430/567

[58] Field of Search ..... 430/567

[56] References Cited

U.S. PATENT DOCUMENTS

| | | | |
|---|---|---|---|
| 4,433,048 | 2/1984 | Solberg et al. | 430/434 |
| 4,439,520 | 3/1984 | Kofron et al. | 430/434 |
| 4,665,012 | 5/1987 | Sugimoto et al. | 430/567 |
| 5,250,403 | 10/1993 | Antoniades et al. | 430/505 |
| 5,314,793 | 5/1994 | Chang et al. | 430/506 |

OTHER PUBLICATIONS

Buhr et al., Research Disclosure, vol. 253, Item 25330, May 1985.

*Primary Examiner*—Janet C. Baxter

*Attorney, Agent, or Firm*—Carl O. Thomas

[57] ABSTRACT

A radiation-sensitive emulsion is disclosed in which greater than 90 percent of total grain projected area is accounted for by high aspect ratio tabular grains, the halide content of which is primarily bromide, but with a speed enhancing amount of iodide also present. The tabular grains are ultrathin and exhibit low temperature stimulated fluorescence indicative of the iodide crystal lattice modifications produced by abrupt iodide introduction known to enhance photographic speed. Tabular grain structures are present having a central region accounting for at least 5 mole percent of total silver forming the tabular grain, an annular region laterally surrounding said central region and exhibiting a maximum iodide concentration, and a peripheral region laterally surrounding the annular region and accounting for greater than 25 percent of total silver forming the tabular grain.

7 Claims, 1 Drawing Sheet

ULTRATHIN TABULAR GRAIN EMULSION

FIELD OF THE INVENTION

This invention relates to silver halide photography. More specifically, the invention relates to radiation-sensitive photographic emulsions useful in silver halide photography.

BACKGROUND

Kofron et al U.S. Pat. No. 4,439,520 was the first to demonstrate a variety of photographic advantages to be realizable utilizing high aspect ratio tabular grain silver halide emulsions. The term "tabular grain emulsion" is applied to silver halide emulsions in which tabular grains, those having two parallel major faces larger than any remaining grain faces, account for greater than 50 percent of total grain projected area. The term "high aspect ratio" as applied to tabular grain emulsions indicates those emulsions in which the ratio of mean grain equivalent circular diameter (ECD) to mean grain thickness (t) is greater than 8. Kofron et al recognized the importance of controlling tabular grain thickness, with tabular grain thicknesses for most photographic applications taught to be less than 0.3 μm and preferably less than 0.2 μm.

Solberg et al U.S. Pat. No. 4,433,048, an improvement on the high aspect ratio tabular grain emulsions of Kofron et al, demonstrates that in silver iodobromide tabular grains a higher iodide concentration in a laterally displaced region of the tabular grain than in a central region results in higher photographic speeds without affecting granularity. That is, improved speed-granularity relationships are obtained. Solberg et al teaches either gradually or abruptly altering iodide concentrations during tabular grain precipitation. Solberg et al teaches that when the iodide level within the grain is gradually increased the central region of the grain need not be large, ranging from 2 to 50 mole percent, preferably 4 to 15 mole percent, of total silver forming the tabular grain. On the other hand, Solberg et al teaches to delay abrupt iodide concentration increases until the central region accounts for from 75 to 97 percent of the total silver forming the tabular grain structure. This delay in abrupt iodide addition is intended to avoid any disruption of the desired tabular form of the grains.

Although iodide nonuniformity accounts for improvement in speed-granularity relationships whether iodide concentrations are increased gradually or increased abruptly, the latter offers larger photographic advantages. Analytical investigations indicate that abrupt iodide concentration increases produce a distinct structure as compared to iodide that is gradually increased. One technique for observing this is by observing low temperature photoluminescence. When iodide is uniformly distributed within silver iodobromide tabular grains or non-uniformly distributed, but with gradual variations in iodide concentrations, exposure of the tabular grains at a temperature of 6° K. to electromagnetic radiation at a wavelength of 325 nm results in a fluorescent emission having a peak intensity in the wavelength range of from 490 to 560 nm, but at 600 nm the intensity of the emission is less than 1.0 percent of the peak emission. When, however, iodide has been introduced into the grain structure abruptly, the luminescence stimulated in the same way is shifted so that at 600 nm the intensity of the emission is greater than 5 percent of the peak emission intensity. Chang et al U.S. Pat. No. 5,314,793 illustrates the advantages of photographic elements that employ high aspect ratio tabular grain silver iodobromide emulsions producedby abrupt iodide introductions.

Although it was recognized by Kofron et al that thin (<0.2 μm) high aspect ratio tabular grain emulsions are photographically preferred, not until recently has it become apparent that there are significant photographic advantages to be gained by employing high aspect tabular grain iodobromide emulsions that are ultrathin, where "ultrathin tabular grain emulsions" are understood to be those than exhibit mean tabular grain thicknesses of less than 0.07 μm. Ultrathin tabular grain emulsions, particularly when the tabular grains account for a high percentage of total grain projected area are particularly useful in producing images of increased sharpness. Antoniades et al U.S. Pat. No. 5,250,403 demonstrates highly advantageous photographic elements employing these emulsions.

A significant advantage of ultrathin tabular grain emulsions is that they do not exhibit reflection maxima within the visible spectrum, as is recognized to be characteristic of tabular grains having thicknesses in the 0.18 to 0.08 μm range, as taught by Buhr et al, *Research Disclosure,* Vol. 253, Item 25330, May 1985. *Research Disclosure* is published by Kenneth Mason Publications, Ltd., Dudley House, 12 North St., Emsworth, Hampshire P010 7DQ, England. In multilayer photographic elements overlying emulsion layers with mean tabular grain thicknesses in the 0.18 to 0.08 μm range require care in selection to avoid reducing the imaging response of underlying emulsion layers by reason for reflecting light that these emulsions require for imaging. The choice of ultrathin tabular grain emulsions in building multilayer photographic elements eliminates spectral reflectance dictated choices of different mean grain thicknesses in the various emulsion layers overlying other emulsion layers. Hence, the use of ultrathin tabular grain emulsions not only allows improvements in photographic performance, it also offers the advantage of simplifying the construction of multilayer photographic elements.

Problem to be Solved

With the recognition of advantages to be gained by employing ultrathin tabular grain emulsions, a need has arisen for ultrathin tabular grain silver iodobromide emulsions that exhibit the iodide profiles that produce improved speed (correlated to significant 600 nm photoluminescence). Chang et al, cited above, teaches advantages for high aspect ratio tabular grain iodobromide emulsions with significant 575 nm photoluminescence; however, none of the emulsions of Chang et al are ultrathin tabular grain emulsions. Antoniades et al, cited above, teaches the advantages of ultrathin tabular grain emulsions, but did not employ in the Examples reported emulsions that demonstrate significant 600 nm photoluminescence.

Antoniades et al cites Solberg et al as one possible approach for iodide management, but does not point out whether gradual or abrupt iodide introduction was contemplated. Certainly the former is clearly more compatible with obtaining ultrathin tabular grain structures and, absent some other explicit teaching, would be selected.

One of the distinct problems which Solberg et al recognized in preparing high aspect ratio tabular grain emulsions with abrupt iodide introduction was that early addition can lead to unwanted thickening of the tabular grains. For this reason, Solberg et al suggests that the central region of the tabular grain should account for at least 75 mole percent of total silver before abrupt iodide addition occurs. Locating maximum iodide concentrations in the last 25 percent of the tabular grain structure precipitated places the iodide in a disadvantageous position in that maximum iodide concentrations are liberated into the developer solution in the early stages of development.

SUMMARY OF THE INVENTION

The invention improves upon the prior state of the art in providing ultrathin high aspect ratio tabular grain iodobromide emulsions in which enhanced speed without granularity increase is realized by abrupt iodide incorporations (correlated with photoluminescence properties) and with the maximum iodide concentrations in the ultrathin tabular grains being shifted laterally to a more central location in each tabular grain projected area. It is surprising that iodide introductions that result in significant 600 nm photoluminescence can be tolerated at such an early stage of precipitation while still achieving ultrathin tabular grains. The 600 nm photoluminescence is evidence of iodide induced disruptions in the face centered cubic crystal lattice structure of the grains, which are also believed to account for increased speed. It was not predicted or expected that iodide induced crystal lattice disruptions at such an early stage of precipitation could be compatible with obtaining ultrathin tabular grain structures.

In one aspect this invention is directed to a radiation-sensitive emulsion comprised of a dispersing medium and silver halide grains, greater than 90 percent of total grain projected area being accounted for by tabular grains having {111} major faces, exhibiting an average aspect ratio of greater than 8, and containing greater than 50 mole percent bromide and at least 0.5 mole percent iodide, based on total silver, wherein the tabular grains (1) have a mean thickness of less than 0.07 μm (2) are capable of producing, when exposed to 325 nm electromagnetic radiation at 6° K., a stimulated fluorescent emission at 600 nm that is at least 2 percent of the maximum intensity of the stimulated fluorescent emission in the wavelength range of from 490 to 560 nm, and (3) are comprised of tabular grains each having a central region accounting for at least 5 percent of total silver forming the tabular grain, an annular region laterally surrounding said central region and exhibiting a maximum iodide concentration, and a peripheral region laterally surrounding the annular region and accounting for less than 25 percent of total silver forming the tabular grain.

BRIEF DESCRIPTION OF THE DRAWINGS

The invention can be better appreciated by reference to the following detailed description considered in conjunction with the drawings, in which

FIG. 1 illustrates a conventional tabular grain structure of the type disclosed by Solberg et al, cited above, and FIG. 2 illustrates a novel tabular grain structure according to the invention.

DESCRIPTION OF PREFERRED EMBODIMENTS

Figure 1:
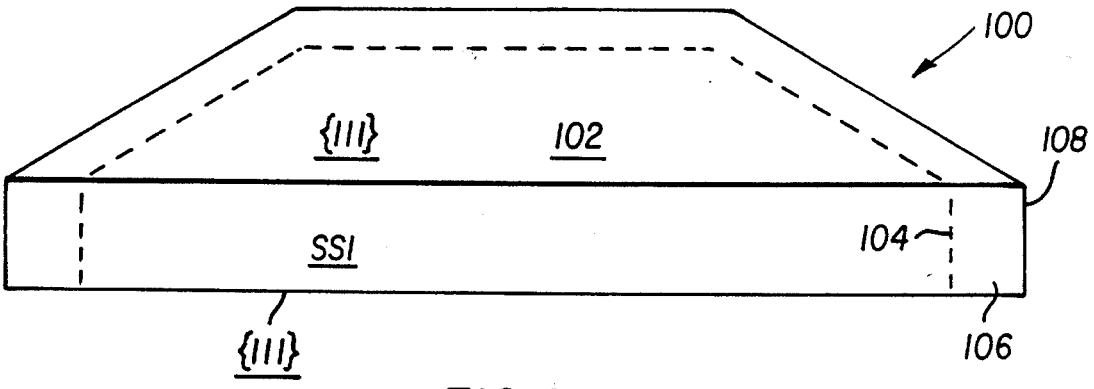
FIG. 1 (prior art)
FIGS. 1 and 2 are schematic isometric views, partly in section, of tabular grains with abruptly introduced iodide.

In FIG. 1 one half of a conventional tabular grain structure 100 of the type disclosed by Solberg et al, cited above, is shown. The grain is shown isometrically and in section so that the iodide profile of the grain both in its interior and at the surface of the grain can be visualized. The tabular grain has upper and lower major faces lying in parallel {111} crystal planes. The edge surface SS1 created by sectioning is oriented toward the viewer. The tabular grain is formed by first precipitating the central region 102 of the tabular grain. The central region accounts for from 75 to 97 percent of total silver used to form the tabular grain. The lateral extent of the central region is indicated by dashed boundary 104. The portion of the tabular grain precipitated after the central region is precipitated is referred by Solberg et al as the laterally displaced region, indicated at 106 in FIG. 1. The laterally displaced region extends from the outer edge 108 of the tabular grain inwardly to the dashed boundary 104. The laterally displaced region contains a higher iodide concentration than the central region, and the iodide is abruptly introduced in forming the laterally displaced region to create crystal lattice disruptions that contribute increased speed.

Figure 2:
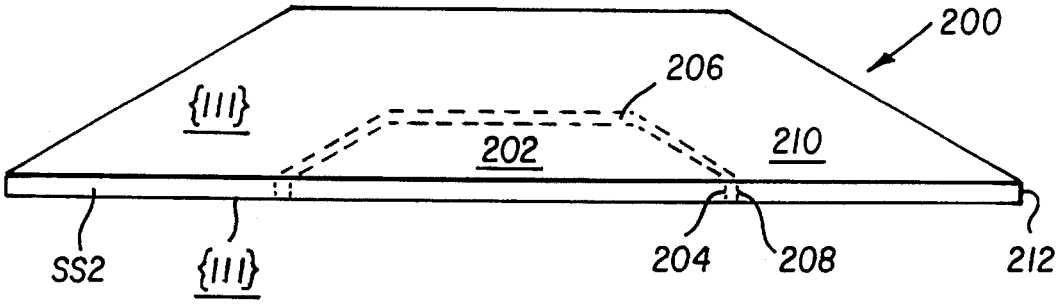

In FIG. 2 one half of a novel ultrathin tabular grain structure 200 contemplated by the present invention is illustrated. The tabular grain has upper and lower major faces lying in parallel {111} crystal planes. The edge surface SS2 created by sectioning is oriented toward the viewer. The tabular grain is formed of a central region 202 having an exterior boundary 204. The central region accounts for at least 5 percent (preferably at least 10 percent and optimally at least 15 percent) of total silver forming the ultrathin tabular grain structure. Laterally surrounding the central region is an annular region 206 which contains the maximum iodide concentration present in the grain structure. The annular region is formed by the abrupt introduction of an increased iodide ion concentration during precipitation. The annular region can account for up to 25 percent (preferably up to 10 percent and optimally up to 5 percent) of the total silver forming the tabular grain. Laterally surrounding the annular region and forming a boundary 208 with it is a peripheral region 210 which extends to the outer edge 212 of the tabular grain. The peripheral region accounts for the balance of the tabular grain not included within the central or annular region. The peripheral region in all instances accounts for greater than 25 percent of the total silver forming the tabular grain structure.

In an ideal emulsion satisfying the requirements of the invention all of the grains present would be tabular grains of the structure shown in FIG. 2. In practice, huge numbers of grains are formed concurrently during emulsion precipitation, and some diversity in grain size and/or structure always exists.

In the emulsions of the invention greater than 90 percent of total grain projected area is accounted for tabular grains having a mean thickness of less than 0.07 μm. The tabular grains exhibit an average aspect ratio of greater than 8—i.e., the emulsions of the invention are high aspect ratio tabular grain emulsions.

The tabular grains exhibit a face centered cubic crystal lattice structure formed by silver and halide ions. Bromide ions constitute at least 50 mole percent, based on total silver, and iodide ions constitute at least 0.5 mole percent of total silver. Overall iodide ion concentrations of up to about 15 mole percent, based on total silver, are contemplated, with maximum iodide concentrations of up to about 10 mole percent being preferred for the vast majority of photographic applications. It is generally preferred that the minimum overall iodide concentration in the emulsions of the invention be at least 1 mole percent, based on total silver.

In one specifically preferred form the emulsions of the present invention are silver iodobromide emulsions. In referring to grains and/or emulsions containing more than one halide, the halides are in every instance named in order of ascending concentrations.

It is possible to include minor amounts of chloride ion in the emulsions of the invention. As disclosed by Delton U.S. Ser. No. 139,971, filed Oct. 21, 1993, now U.S. Pat. No. 5,372,927, here incorporated by reference, and Delton U.S. Ser. No. 238,199, filed May 4, 1994, titled CHLORIDE CONTAINING HIGH BROMIDE ULTRATHIN TABULAR GRAIN EMULSIONS, now abandoned in favor of U.S. Ser. No. 304,034, filed Sep. 9, 1994, all commonly assigned, ultrathin tabular grain emulsions containing from 0.4 to 20 mole percent chloride and up to 10 mole percent iodide, based on total silver, with the halide balance being bromide, can be prepared by conducting grain growth accounting for from 5 to 90 percent of total silver within the pAg vs. temperature (°C.) boundaries of Curve A (preferably within the boundaries of Curve B) of Piggin et al U.S. Pat. Nos. 5,061,609 and 5,061,616, the disclosure of which is here incorporated by reference. Under these conditions of precipitation the presence of chloride ion actually facilitates reducing the thickness of the tabular grains. Although it is preferred to employ precipitation conditions under which chloride ion, when present, can contribute to reductions in the tabular grain thickness, it is recognized that chloride ion can be added during any conventional ultrathin tabular grain precipitation to the extent it is compatible with retaining tabular grain mean thicknesses of less than 0.07 μm.

Tabular grain emulsions satisfying the requirements of the invention exhibit a spectral distribution of photoluminescence indicative of the abrupt (commonly referred to as "dump") addition of iodide ion in forming the annular regions of the tabular grains. Specifically, the emulsions contemplated for use in the practice of the invention are those that, when exposed to 325 nm electromagnetic radiation at 6° K., exhibit a stimulated fluorescent emission at 600 nm that is at least 2 percent of the maximum intensity of the stimulated fluorescent emission in the wavelength range of from 490 to 560 nm. The exact wavelength at which maximum fluorescent emission occurs is a function of the amount of iodide present in the central and peripheral portions of the tabular grains. Thus iodide, by reason of having been progressively introduced (commonly referred to as "run") into the reaction vessel as precipitation progresses, is integrated into the face centered cubic crystal lattice of the tabular grains formed by silver bromide. In the absence of iodide ion abruptly introduced during tabular grain growth the intensity of fluorescent emission at 600 nm is on the order of less than about 1 percent the peak emission intensity.

In the emulsions of the present invention, wherein iodide ion concentrations are abruptly increased (e.g., dumped into the reaction vessel) in forming the annular regions of the grains, the intensity of fluorescent emission at 600 nm in response to stimulation by 325 nm electromagnetic radiation is at least 2 percent of the peak intensity fluorescent emission, which occurs in the spectral region of from about 490 to 560 nm. In fact, in preferred emulsions according to the invention in which all of the tabular grains contain an annular region, fluorescent emission at 600 nm stimulated by 325 nm electromagnetic radiation is at least 5 percent and typically in the range of from >5 to 10 percent, of peak intensity fluorescent emission in the wavelength range of from 490 to 560 nm. It is therefore recognized that emulsions of the invention can include emulsions prepared by blending with emulsions having the tabular grain structure of FIG. 2 one or more conventional tabular grain emulsions that can be accommodated within the overall halide and tabular grain requirements stated above, but lacking the abruptly introduced iodide ion necessary to produce an significant amount of 600 nm fluorescent emission. Requiring the overall emulsion to maintain at the least 2 percent 600 nm fluorescent emission stated above insures that the proportion of tabular grains containing abruptly introduced iodide ion remains sufficient to improve photographic speed. Emulsion blending is a common practice for precisely matching product aim photographic characteristics (e.g., speed and/or contrast).

In the tabular grains satisfying the structure of FIG. 2, the annular region contains at least a 1 mole percent higher iodide concentration than the central region and the peripheral region. Iodide ion concentration in the annular region is preferably in the range of from about 5 to 20 mole percent iodide. The iodide in the annular regions of the tabular grains is the only required iodide in the emulsions of the invention. It is generally preferred that iodide in the annular region account for at least 0.5 and preferably greater than 1 mole percent of total halide, based on silver. The central and peripheral regions preferably contain less than 5 mole percent iodide and optimally less than 3 mole percent iodide.

Apart from the features specifically described, the structure of the emulsions satisfying the requirements of the invention can take any convenient conventional form. It is usually preferred that the highest attainable proportion of total grain projected area be accounted for by tabular grains. Thus tabular grain projected areas of greater than 97 percent, demonstrated by Antoniades et al, cited above, are preferred. The emulsions can be polydisperse or monodisperse. Although emulsion blending for photographic use can increase apparent grain dispersity, as precipitated the tabular grain emulsions contributing the grain structures of FIG. 2 preferably exhibit a coefficient of variation (COV) of less than 50 percent, most preferably less than 30 percent, and optimally less than 20 percent. COV is 100 times the quotient of the standard deviation (σ) of grain ECD divided by mean ECD. The mean ECD of the emulsions can range from any minimal value capable of satisfying high mean aspect ratio requirements up to the highest photographically useful values, typically identified as about 10 μm. In practice, mean ECD values of up to about 5 μm are usually preferred for photographic applications. Typically mean ECD values of less than about 3.5 μm are contemplated, with mean ECD being increased to increase photographic speed at the expense of image granularity and decreased to improve image granularity. Although minimum ultrathin tabular grain thicknesses of down to 0.01 μm have been suggested by Antoniades et al, mean ultrathin tabular grain thicknesses of greater 0.02 μm or 0.03 μm are usually preferred from the standpoint of permitting a greater range of precipitation conditions. The average aspect ratios of the ultrathin tabular grain emulsions of the invention can be extremely high, since aspect ratio (ECD/t) is necessarily increased as tabular grain thickness is minimized.

The emulsions of the invention can be prepared by modifying known techniques for preparing ultrathin tabular grain emulsions satisfying the emulsion requirements of the invention, but lacking the teaching of an abrupt iodide introduction. The central and peripheral regions of the tabular grains can be precipitated employing known techniques for precipitating ultrathin tabular grain emulsions taught by Antoniades et al and Delton, both cited above; Daubendiek et al U.S. Pat. Nos. 4,414,310 and 4,693,964; *Research Disclosure,* Aug. 1983, Item 23212, Example 1; and Zola and Bryant published European patent application 0 362 699, Examples 5 to 7; the disclosures of which are here incorporated by reference.

These precipitations are modified by abruptly introducing increased levels of iodide after the central region has been precipitated and before the peripheral region has been precipitated. Abrupt iodide additions can be undertaken following the procedures taught by Solberg et al and Chang et al, both cited above and here incorporated by reference, except that the specific teachings provided above for location of the abruptly introduced iodide must be followed.

The incorporation and use of the emulsions in photographic elements can take any convenient form. Photographic element features and their use are summarized in *Research Disclosure,* December 1989, Item 308119.

EXAMPLES

The emulsions of the invention, their properties, and the procedures by which are formed can be better appreciated by reference to the following specific examples:

Emulsion Preparations

All of the emulsions are silver iodobromide tabular grain emulsions exhibiting a mean ECD of 2.2±0.2 μm except Emulsion E, which exhibited an ECD of 1.3 μm. Iodide amounting to 2.6 mole percent, based on silver, was progressive introduced (i.e., run) into the reaction vessel in all emulsion precipitations. Abrupt (i.e., dump) iodide introduction was additionally undertaken in the preparation of the emulsions other than Emulsion A. by introducing a silver iodide Lippmann emulsion in an amount equal to 1.5M percent of total silver used during precipitation.

Emulsion A (comparative emulsion)

This emulsion was prepared using only progressively introduced (i.e., run) iodide. The emulsion was prepared to provide a reference for photographic speed comparisons.

Six liters of distilled water with 7.5 g of oxidized gelatin and 0.7 mL of antifoaming agent were added to a reaction vessel equipped with efficient stirring. The solution in the reaction vessel was adjusted to 45° C., pH 1.8 and pAg 9.1. In the nucleation, 12 mmol of $AgNO_3$ and 12 mmol of NaBr+KI (98.5:1.5 molar ratio) solutions were simultaneously added to the vessel reactor at constant flow rates over a period of 4 seconds. The temperature was raised to 60° C. and 100 g of oxidized gelatin in 750 mL of distilled water were added to the solution. The pH was adjusted to 5.85 with NaOH and the pAg t 9.0 at 60° C. In the first growth period, 0.83 mol of 1.6M $AgNO_3$ and 0.808 mol of 1.75M NaBr solutions were added to the reactor at constant flow rates over a period of 40 min. Concurrently, 0.022 mol of Lippman AgI emulsion was also added at a constant flow rate. The Br:I molar ratio was 97.4:2.6 during this growth period. The pAg of the liquid emulsion was adjusted to 9.2 with NaBr at 60° C. In the second growth period, the precipitation was continued with the same 1.6M $AgNO_3$, 1.75M NaBr and Lippman AgI solutions and the same mode of addition except for the flow rates for the 1.6M $AgNO_3$ and 1.75 M NaBr solutions being accelerated from 13 cc/min to 96 cc/min in a period of 57 minutes. Like in the first growth period, the Br:I molar ratio was maintained at 97.4:2.6. The total amount of emulsion precipitated was 6 moles. The emulsion was then conagulation washed.

Significant features of the emulsion are summarized in Table I below.

Emulsion B (comparative emulsion)

This emulsion was prepared using the same run iodide addition as Emulsion A, but in addition abruptly introducing (i.e., dumping) additional iodide after introducing 98.5 percent of the silver.

The precipitation procedure of Emulsion B was identical to that of Emulsion A, except that 0.09 mole of Lippman AgI emulsion was added (dumped) to the liquid emulsion at the end of the second growth period. The amount of the AgI addition was 1.5 mol % of the total silver precipitation.

Significant features of the emulsion are summarized in Table I below.

Emulsion C (invention emulsion)

This emulsion was prepared using the same iodide additions as in Emulsion B, but shifting the step of abruptly introducing (i.e., dumping) additional iodide so that it occurred earlier in the precipitation—specifically after introducing 70 percent of the silver and prior to introducing the final 28.5 percent of the silver.

Significant features of the emulsion are summarized in Table I below.

Emulsion D (invention emulsion)

This emulsion was prepared using the same iodide additions as in Emulsion B, but shifting the step of abruptly introducing (i.e., dumping) additional iodide so that .it occurred earlier in the precipitation-specifically after introducing 30 percent of the silver and prior to introducing the final 68.5 percent of the silver.

Significant features of the emulsion are summarized in Table I below.

Emulsion E (comparative emulsion)

This emulsion was prepared using the same iodide additions as in Emulsion B, but shifting the step of abruptly introducing (i.e., dumping) additional iodide so that it occurred earlier in the precipitation—specifically after introducing only 2 percent of the silver.

Significant features of the emulsion are summarized in Table I below.

TABLE I

| Emulsion | % Ag Before I Dump | Mean Grain Thickness (μm) |
|---|---|---|
| A (comp.) | not applicable | 0.051 |
| B (comp.) | 98.5 | 0.047 |
| C (inv.) | 70 | 0.051 |
| D (inv.) | 30 | 0.058 |
| E (comp.) | 2 | 0.087 |

From Table I it is apparent that Emulsion E exhibited a mean grain thickness of greater than 0.07 μm and therefore failed to satisfy the thickness requirements of an ultrathin tabular grain emulsion. Emulsion E demonstrates that shifting the iodide dump addition to an early stage of precipitation results in unwanted thickening of the tabular grains. Emulsions C and D demonstrate that, contrary to the suggestion of Solberg et al, iodide dump additions need not be deferred until after 75 percent of total silver has been introduced. Further, these earlier iodide dump additions are surprisingly capable of producing ultrathin tabular grain emulsions.

Confirmation of Dump Iodide Crystal Lattice Modifications

Samples of the ultrathin tabular grain emulsions, Emulsion A–D, where each exposed to 325 nm electromagnetic radiation while being maintained at a temperature of 6° K. Peak emission intensity was observed as well as emission intensity at 600 nm. Emission intensity at 600 nm as a percentage of peak emission intensity is summarized in Table II.

TABLE II

| Emulsion | 600 nm Intensity as % of Peak Intensity |
|---|---|
| A (comp.) | 0.7 |
| B (comp.) | 7.0 |
| C (inv.) | 9.2 |
| D (inv.) | 13.3 |

From Table II it is apparent that comparison Emulsion A, which was prepared without abrupt iodide introduction, exhibited low levels of photoluminescence at 600 nm as compared to the remaining ultrathin tabular grain emulsions.

Performance Comparisons

The ultrathin tabular grain emulsions, Emulsion A–D, were each given an identical sensitization by introducing per mole of silver: 150 mg NaSCN, 2.1 mmol of anhydro-5,5'-dichloro-9-ethyl-3,3'-di(sulfopropyl)thiacarbocyanine hydroxide triethylammonium salt (Dye-1) and 0.07 mml of 5-di(1-ethyl-2(1H)-β-naphthothiazolylidene)isopropylidene-1,3 -di(β-methoxymethyl)barbituric acid (Dye-2), 18 μmol of dicarboxy-methyldimethylthiourea, and 6.0 μmol of auroustrimethyltriazolium thiolate. The emulsion sample was given a heat digestion at 65° C. for 15 minutes, followed by the addition of 0.45 mol percent each of KI and $AgNO_3$.

The emulsion samples were then coated on a transparent film support at a silver coating density of 0.537 g/m$^2$.

A coated sample of each emulsion was exposed for 1/100th second through a graduated test object to a 365 nm light source to determine its speed independent of spectral sensitization. Another coated sample of each emulsion then similarly exposed, but with a 5500° K. daylight source through a Wratten™ WR23A filter that limited exposure to wavelengths above 560 nm.

The exposed samples were then identically photographically processed the Kodak Flexicolor™ C-41 process.

Speed comparisons are summarized in Table III. Speed is reported in relative log speed units with the relative speed of Emulsion A being assigned a relative speed of 100. Relative log speed units are 100(1–log E), where E represents exposure in lux-seconds. Speed was measured at an optical density of 0.15 above minimum density.

TABLE III

| Emulsion | 365 nm Exposure speed | Red (>560 nm) Speed |
|---|---|---|
| A (comp.) | 100 | 100 |
| B (comp.) | 28 | 4 |
| C (inv.) | 135 | 131 |
| D (inv.) | 119 | 112 |

Emulsion B demonstrates the adverse effect on photographic speed resulting from dumping iodide late in the precipitation. By comparing Tables I and II and it is apparent that Emulsion B is an ultrathin tabular grain emulsion and exhibits the crystal lattice modification characteristic of a dump iodide emulsion. It would therefore be expected that this emulsion would also offer the photographic advantages of the invention emulsions, Emulsion C and D. In fact, however, only invention Emulsions C and D demonstrated a photographic advantage over Emulsion A, which lacked dump iodide addition.

As a corroboration of 365 nm speed, the procedures reported above for 365 nm exposure samples were repeated, except that Dye-1 and Dye-2 were not present in the emulsion samples. The results are summarized in Table IV.

TABLE IV

| Emulsion | 365 nm Exposure Speed |
|---|---|
| A (comp.) | 100 |
| B (comp.) | 9 |
| C (inv.) | 111 |
| D (inv.) | 127 |

This confirms that the presence of red absorbing spectral sensitizing dyes Dye-1 and Dye-2 did not play any significant role in the 365 nm exposure speed advantages for the ultrathin tabular grain emulsions of the invention, Emulsions C and D.

The invention has been described in detail with particular reference to preferred embodiments thereof, but it will be understood that variations and modifications can be effected within the spirit and scope of the invention.

What is claimed is:

1. A radiation-sensitive emulsion comprised of a dispersing medium and silver halide grains, greater than 90 percent of total grain projected area being accounted for by tabular grains having {111} major faces, exhibiting an average aspect ratio of greater than 8, and containing greater than 50 mole percent bromide and at least 0.5 mole percent iodide, based on total silver, wherein said tabular grains have a mean thickness of less than 0.07 μm, are capable of producing, when exposed to 325 nm electromagnetic radiation at 6° K., a stimulated fluorescent emission at 600 nm that is at least 2 percent of the maximum intensity of the stimulated fluorescent emission in the wavelength range of from 490 to 560 nm, and are comprised of tabular grains each having a central region accounting for at least 5 percent of total silver forming the tabular grain, an annular region laterally surrounding said central region accounting for at least 0.5 and up to 10 percent of total silver forming the tabular grain and exhibiting a maximum iodide concentration, and a peripheral region laterally surrounding the annular region and accounting for greater than 25 percent of total silver forming the tabular grain.

2. An emulsion according to claim 1 wherein said tabular grains account for greater than 97 percent of total grain projected area.

3. An emulsion according to claim 1 wherein said annular region contains at least 1 mole percent higher iodide concentration than the adjacent central and peripheral regions.

4. An emulsion according to claim 1 wherein said central region accounts for at least 10 percent of total silver forming the tabular grain.

5. An emulsion according to claim 4 wherein said central region accounts for at least 15 percent of total silver forming the tabular grain.

6. An emulsion according to claim 1 wherein said annular region contains up to 5 percent of total silver forming the tabular grain.

7. A radiation-sensitive emulsion comprised of a dispersing medium and silver iodobromide grains, greater than 97 percent of total grain projected area being accounted for by tabular grains having {111} major faces, exhibiting an average aspect ratio of greater than 8, and containing from 1 to 10 mole percent iodide, based on total silver, wherein said tabular grains have a mean thickness of less than 0.07 μm, are capable of producing, when exposed to 325 nm electromagnetic radiation at 6° K., a stimulated fluorescent emission at 600 nm that is at least 5 percent of the maximum intensity of the stimulated fluorescent emission in the wavelength range of from 490 to 560 nm, and are comprised of tabular grains each having a central region accounting for at least 15 mole percent of total silver forming the tabular grain, an annular region laterally surrounding the central region and accounting for up to 10 mole percent of total silver forming the tabular grain, and a peripheral region laterally surrounding the annular region and accounting for greater than 25 percent of total silver forming the tabular grain, said annular region exhibiting an iodide concentration exceeding that of said central and peripheral regions by at least 1 mole percent.

* * * * *